United States Patent [19]

Kuminecz et al.

[11] Patent Number: 4,519,545

[45] Date of Patent: May 28, 1985

[54] SPRAY APPLICATOR FOR SPRAYING COATINGS AND OTHER FLUIDS IN SPACE

[75] Inventors: Jerome F. Kuminecz; Merlyn F. Lausten, both of Houston, Tex.

[73] Assignee: The United States of America as represented by the Administrator of the National Aeronautics and Space Administration, Washington, D.C.

[21] Appl. No.: 392,094

[22] Filed: Jun. 25, 1982

[51] Int. Cl.[3] ..... B05B 9/047

[52] U.S. Cl. ..... 239/288; 239/322; 239/327; 239/375; 239/590; 239/DIG. 23; 55/DIG. 42

[58] Field of Search ..... 239/322, 323, 499, 150, 239/526, 590, 104, 326–328, 378, 459, 288–288.5, 375, DIG. 23; 222/402.11, 402.15; 210/460, 461, 497.1, 499; 55/DIG. 42–DIG. 45

[56] References Cited

U.S. PATENT DOCUMENTS

| | | | |
|---|---|---|---|
| 2,966,960 | 1/1961 | Rochlin | 55/DIG. 42 |
| 3,184,118 | 5/1965 | Webster | 239/142 X |
| 3,584,789 | 6/1971 | Traynor | 239/459 X |
| 3,828,977 | 8/1974 | Borchert | 222/131 X |
| 3,880,355 | 4/1975 | Larson et al. | 239/526 X |
| 3,938,708 | 2/1976 | Burger | 239/323 X |
| 4,043,510 | 8/1977 | Morris | 239/322 X |
| 4,192,462 | 3/1980 | Erickson | 239/288 |
| 4,220,285 | 9/1980 | Gualdi | 239/590 X |
| 4,274,562 | 6/1981 | Medeiros et al. | 222/131 X |
| 4,350,507 | 9/1982 | Greenough et al. | 55/DIG. 42 X |

FOREIGN PATENT DOCUMENTS

| | | | |
|---|---|---|---|
| 2238019 | 2/1974 | Fed. Rep. of Germany | 239/526 |
| 2255786 | 7/1975 | France | 239/499 |

*Primary Examiner*—Andres Kashnikow

*Attorney, Agent, or Firm*—Russell E. Schlorff; John R. Manning; Marvin F. Matthews

[57] ABSTRACT

The object of the invention is to provide a self-contained spray applicator for one handed operation in a zero gravity vacuum environment by a free-flying astronaut not attached to any spacecraft while avoiding contamination of the operator by back spray.

Said applicator includes a rigid accumulator (12) for containment of a fluid (17) within a flexible bladder (16), the fluid being urged out of the accumulator under pressure through a spray gun (13). The spray gun includes a spring loaded lockable trigger (47) which controls a valve (56). When in an open position, the fluid passes through the valve into the ambient environment in the form of a spray. A spray shield (14) is provided which directs the flow of the spray from the applicator by trapping errant particles of spray yet allowing the passage of escaping gases through its material. This reduces the reactive force exerted by the escaping spray on the operator of the applicator. The spray shield consists of two concentric layers of open celled urethane foam with the inner layer consisting of a coarser grain than the outer, thereby trapping progressively finer particles of spray.

8 Claims, 2 Drawing Figures

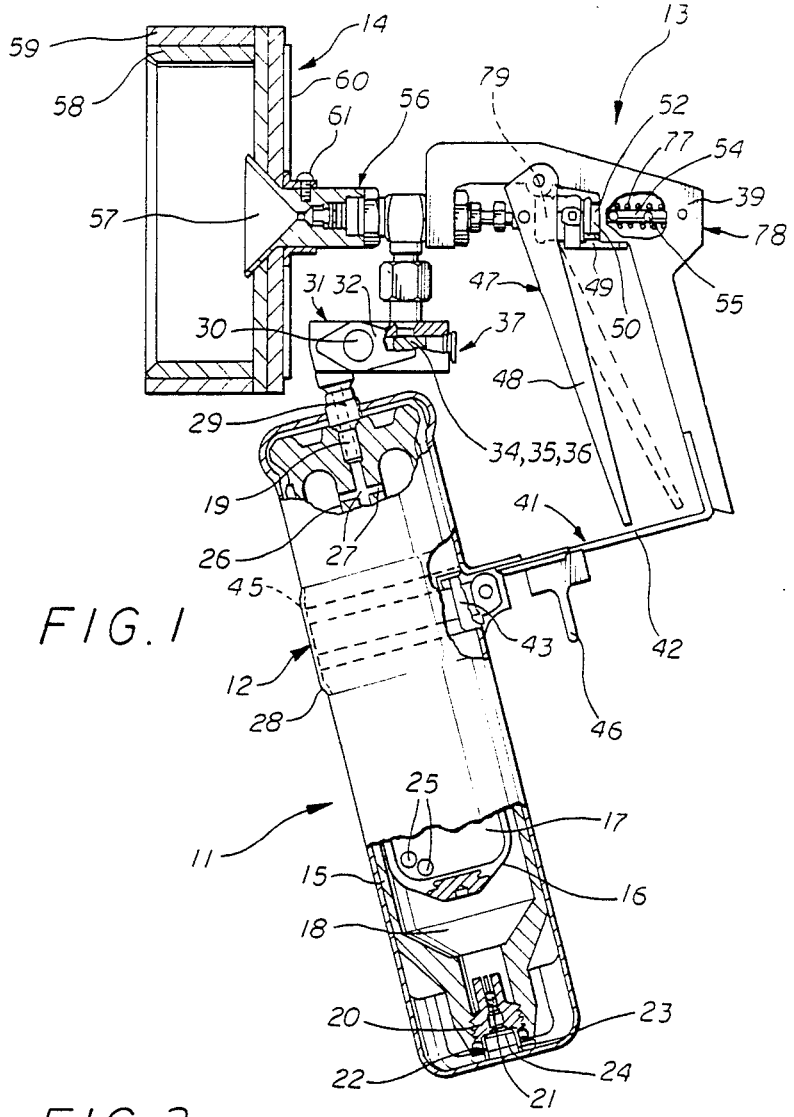
FIG. 1
FIG. 2
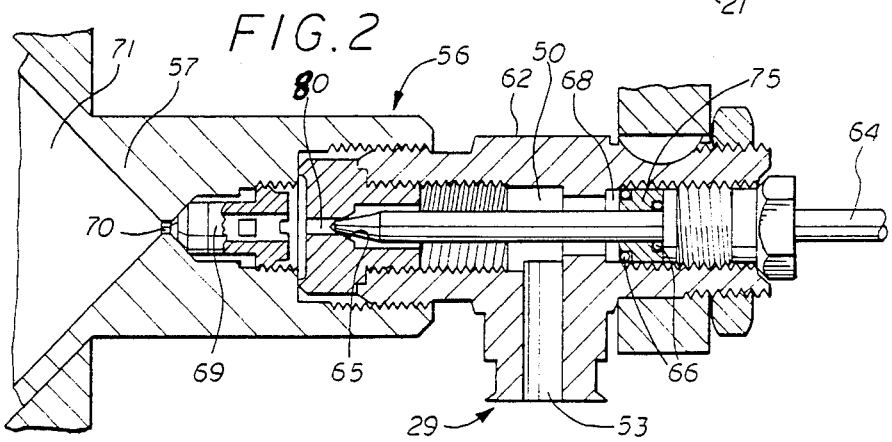

SPRAY APPLICATOR FOR SPRAYING COATINGS AND OTHER FLUIDS IN SPACE

ORIGIN OF THE INVENTION

The invention described herein was made by an employee of the United States Government and may be manufactured and used by or for the Government of the United States of America for governmental purposes without the payment of any royalties thereon or therefor.

TECHNICAL FIELD

The invention claimed herein relates generally to a self-contained spray applicator for one handed operation in a zero gravity vacuum environment, while avoiding contamination of the operator by back spray. More specifically, the claimed invention relates to a device for applying a coating of heat protective material to damaged portions of the exterior of space craft while in space, so as to permit the safe re-entry of the space craft to the earth's surface.

In the operation of the spray applicator, it is essential that the device be self-contained so as to not encumber an astronaut or unduly restrict his or her mobility while conducting repairs on the exterior of the space craft. Further, it is equally essential that the spray applicator be suitable for one handed operation, likewise so as to not unduly restrict mobility. Both of these requirements are necessary to permit the operator to apply the spray coating while "free-flying", that is, while not attached to the spacecraft. In addition, one hand must be free to operate a space maneuvering unit, both to travel to different locations around the spacecraft, as well as to control the operator's position in space while operating the spray applicator. Further, it is important that the spray applicator prevent or eliminate the back spray of the liquid and particles being emitted from the spray applicator, which may contaminate and/or endanger the operator while effecting repairs when in the zero-gravity environment of outer space. Additionally, under zero-gravity conditions, the spray applicator must not allow the liquid emitting therefrom to exert too large a reactive force tending to accelerate the operator in a direction opposite to that from which the liquid is expelled.

Existing spray applicator designs would probably be wholly inoperative with respect to the intended operating environment of the claimed invention. For example, U.S. Pat. No. 2,823,953, issued to McGeorge, reveals a self-pressurized enclosure, including a flexible inner bladder containing a liquid and a tube extending outwardly therefrom controlled by a valve. However, McGeorge fails to facilitate one hand operation, as well as other requirements for use in space.

U.S. Pat. No. 2,597,573, issued to De Groff, teaches the use of a pressurized air stream to form an enclosing wall with a conical spray guard mounted concentrically with the emitting orifice of a spray gun. Although this device assists in the prevention of back spray, it is apparent that its continued operation is wholly dependent upon an external source of compressed air, thus not self-contained in a remote space environment, as well as having other deficiencies.

SUMMARY OF THE INVENTION

The present invention obviates these and other limitations and fulfills the requirements of the intended application by providing a self-contained, self-pressurized canister containing an inner flexible bladder in which the liquid spray material is contained. The space between the exterior canister and one side of the interior bladder is pressurized, thus exerting a compressive force on the flexible bladder tending to eject the liquid material through an outlet port. A bladder or other barrier coating and pressure source is needed to control a liquid in a zero environment. The emission of the liquid material is controlled by a spray gun mounted on the canister and activated by a self-locking trigger carried adjacent a handle so as to permit one handed operation thereby. A cup-like spray guard is mounted over the nozzle and orifice so as to envelop the spray of liquid and solid material emitted therefrom. Thus, the present invention describes a design which allows one handed operation of a self-contained spray applicator, including a spray guard designed for minimizing back spray and reactive forces on the operator.

Therefore, these and numerous other features and advantages of the invention will become more clearly evident upon a careful reading of the following detailed description, claims and drawings, wherein like numerals denote like parts in the several views, and wherein:

DESCRIPTION OF THE DRAWINGS

FIG. 1 illustrates a cross-sectional view of the invention.

FIG. 2 shows a detailed cross-sectional view of the trigger activated valve of the invention.

DETAILED DESCRIPTION OF THE INVENTION

Referring now to FIG. 1, the numeral 11 generally indicates the self-contained spray applicator as herein described. The spray applicator 11 includes an accumulator 12, a spray gun 13, and a spray shield 14. Turning now to the accumulator 12, the major components thereof include a rigid outer shell or canister 15, which contains an inner flexible bladder 16 and a head 26. The liquid coating material 17 is contained within the bladder 16. A pressurized propellant 18 may be injected into the outer shell 12 so as to apply a constrictive force on the bladder 16, thereby inducing the liquid coating material 17 to exit the bladder through an outlet passageway 19 located in head 26 at one end of the outer shell and bladder. The pressurized propellant may be injected into the rigid outer shell through an adapter assembly 20 threaded within the accumulator at he end opposite the outlet passageway 19. The adapter assembly 20 includes a valve 21 for controlled injection of the propellant, a conventional O-ring 22 annularly mounted with respect to the adapter assembly so as to provide an effective seal with respect to the pressurized propellant contained within the accumulator, and a removable adapter plug 23 threaded above the exposed end of the valve 21 and an additional O-ring 24.

The accumulator 12 will further include one or more weighted balls 25, the motion of which within the bladder assure agitation and uniform distribution of the liquid coating material 17 contained therein, which may tend to stratify and separate during prolonged periods of storage and inactivity. Further, head 26 includes a plurality of orifices 27 of sufficient diameter and located so as to assure uninterrupted flow of the liquid coating material 17 despite any interference from the mixing balls or coagulated material of any individual orifice.

The accumulator 12 will further include a suitable insulation layer 28, whereby the contents thereof are protected from the temperature conditions in the ambient environment during operation of the spray applicator, and in addition, the temperature thereof may be controlled during periods of storage prior to use. This insulating layer 28 is applied in a nearly continuous envelope of material over the outer surface of the outer shell 15.

The escaping coating material 17 is channeled through a passageway 19 in valve assembly 31 connecting the accumulator 12 and the spray gun assembly 13. A shut off plug assembly 30 and external handle 32 in valve assembly 31 may be manually placed in an open position during periods of extended operation and conversely placed in a closed position during periods of inactivity, so as to effectively reduce the possibility of seepage or leakage of the liquid coating material under pressure during storage. Further, the valve assembly 31 will include a removable filter 34, whereby unacceptably large droplets or coagulated masses of coating material are prevented from entering the spray gun assembly. The filter 34 is accessible from the outside through an opening 37 in the valve assembly 31. The opening 37 is sealed by a hex plug 35 and a conventional O-ring 36, both of which may be removed for extraction and cleaning of the filter 34 as necessary.

As previously mentioned, the valve assembly 31 connects the accumulator 12 to the spray gun 13. The spray gun 13 includes handle 39. A handle support assembly 41 connects the handle 39 to the accumulator 12 to provide support and strength to the overall assembly. The handle support assembly 41 includes a bracket 42 fixed at one end to the handle 39 and mounted on the other end on the outer shell 15 of the accumulator 12. The bracket 42 is mounted in encircling engagement with the outer shell 15 through the use of a hose clamp 43. The shell 15 is insulated from bracket 42 and hose clamp 43 by means of a felt 45. The handle support assembly 41 will further include a tether ring 46, whereby a convenient means is provided to secure the spray applicator to the space craft or the operator.

The spray gun 13 further includes a trigger means 47, which in the preferred embodiment of the invention includes a lever 48 pivotally mounted to the spray gun handle 39 at one end thereof and in a closed position is substantially parallel to the handle 39, and when the lever 48 is rotated manually towards the handle 39, it assumes an open position. The significance of the open and closed positions of the lever 48 will be explained more fully at a later time. A self-locking trigger lock 49 is further provided to prevent inadvertent operation of the spray applicator. A lock spindle 50 is mounted in the spray gun handle 39. A lock spring 52 is concentrically mounted on the lock spindle 50 so as to prevent the lock 49 from rotating into an indentation 79 in the body of the trigger lever 48. However, the lock spring 52 exerts a torsional force on the asymmetrical lock 49 so as to prevent it from assuming the orientation suitable for engagement and insertion into the identation 79. Thus, movement of the trigger lever 48 towards the handle 39 and therefore into an open position, is prevented until the torsional force exerted by the trigger spring 52 is manually overcome and the lock 49 is rotated so as to be inserted into the identation 79. Also included is a spring stop 54, for a second spring 77, which is concentrically arranged behind the lock spindle 50 and may be adjustably positioned inside the handle 39 and locked thereon by means of a conventional set screws or the like 55. The spring load for sealing valve set 65 by shut off needle 64 is adjusted by insertion and rotation of a hex head wrench into stop 54 through a hole 78 to increase or decrease the load on spring 77.

The action of the trigger means 47 actuates a valve 56 controlling the outflow of liquid coating material 17 into passageway 80. Positioning the trigger means 47 in an open position correspondingly opens the valve 56 allowing the liquid coating material 17 to escape through a nozzle 57 to the ambient environment in the form of a pressurized spray. Concentrically mounted with respect to the nozzle 57, is a spray shield assembly 14, previously mentioned. The spray shield assembly 14 is so constructed as to allow the venting of any associated gases from the emitting spray of liquid coating material, while simultaneously entraping coagulated particles deviating from the desired path of the emitting spray, or bouncing back from the surface being coated.

The spray shield assembly is comprised of an inner shield layer 58 and an outer shield layer 59, both layers concentrically arranged and adjacent one another. The inner shield 58 and the outer shield 59 are both constructed of an open cell flexible urethane foam material, with the inner shield having a core shell structure and the outer shield 59 having a fine cell structure. Specifically, the inner shield will have a composition of approximately 35 pores per inch, whereas the outer shield will have a composition of approximately 65 pores per inch. Thus, in operation, the larger particles of material deviating from the emitting spray, as well as splashback from the surface being coated, will be entrapped by the core cell structure of the inner shield 58 and finer particles will penetrate the inner shield but will be prevented from leaving the spray shield assembly by the fine cell structure of the outer shield 59, while still allowing the venting of gas from the vacuum evaporated coating fluid. Attachment of the spray shield assembly to the spray applicator will be accomplished by an annular flange 60, which will be mechanically attached by a screw 61.

FIG. 2 shows in detail the structure of the valve 56, including an inlet body 62 defining passageways 53 and 50 connecting at one end the valve assembly 31 and at the other end, through passageway 80, the nozzle 57. The flow of liquid coating material 17 through the passageway 80 is controlled through the positioning of a shut off needle 64 concentrically located along the center axis of the passageway 50. The shut off needle has a first end which is connected to the trigger means 47, whereby when the trigger means is in a closed position, the shut off needle is forcibly engaged with a plastic valve seat 65 so as to seal off the nozzle 57 from the coating in passageway 50. When the trigger means 47 is in an open position, the shut off needle 64 is retracted and no longer engages the valve seat 65 nor obstructs the flow of liquid coating material 17 through the passageway 80.

The shut off needle 64 is allowed to slide in and out of the inlet body 62, yet be sealed to the passageway 50 so as to prevent the unwanted emittance of liquid coating material 17, except through the nozzle 57, by a series of sealing materials as shown in FIG. 2. Concentrically arranged around the shut off needle 64 is a shaft seal 75 which includes spring loaded Teflon. O-ring 66 is suitably concentrically arranged with respect to the shaft seal and shut off needle 64. The shut off needle 64 also has suitable threads within the inlet body 62 so as to compress the shaft seal 75 against a packing stop 68, whereby an effective seal is maintained with respect to the inlet body 62 and passageway 50.

In operation, the trigger means 47 is placed in an open position, thus retracting the shut off needle 64 from the valve seat 65 allowing the emittance of liquid coating material 17 through the passageway 80 and the nozzle 57. The nozzle 57 includes a nozzle tip 69 designed to properly atomize the coating in the vacuum environment. Nozzle 57 necks down to an orifice 70 and then conically widens to a funnel like area 71 which shapes and guides the emitting spray of liquid coating material. Under the conditions of zero gravity and vacuum in the ambient environment, it has been observed that an orifice of 0.020 inches in diameter offers the optimum control of the emitting spray when used in conjunction with a funnel with an angular cross-section of 90°.

It should be understood by the reader hereof that the description of the invention herein is set forth for exemplary purposes only and that certain minor changes and/or modifications may be made hereto without departing from the spirit and scope of the invention claimed hereafter.

Therefore, that which is claimed and desired to be secured by United States Letters Patent is:

1. A totally self-contained spray gun for one handed use in a vacuum zero-gravity environment application of a coating material, comprising:

(a) an accumulator means including a rigid outer shell and a flexible bladder contained therein having an outlet port, pressurized propellant contained within the outer shell exteriorly of the bladder, whereby the constricting force exerted by the propellant on the bladder and the liquid coating material contained therein induces the coating material to be extruded through said outlet port under zero-gravity conditions;

(b) a conduit (passageway) having a first end connected to the outlet port of the accumulator, said conduit including an externally controllable shut off plug mounted therewithin for allowing or preventing the outflow of coating material, said conduit further including a removable strainer means sealed and mounted therewithin for filtering out large coagulated particles of coating material;

(c) spray gun means for controlling the explosion of coating material including a housing connected to a second end of the conduit, a handle for gripping and supporting the spray gun and accumulator, and a spring loaded self-locking trigger means having an open and closed position, so arranged with respect to the handle as to permit simultaneous one-hand gripping of the handle and operation of the trigger means;

(d) said trigger means including a lever having a first end pivotally mounted on the spray gun handle assembly, said lever being substantially parallel to the handle of the spray gun housing when the trigger means is in a closed position, and whereby the pivoting of the level toward the handle places the trigger means in an open position;

(e) said trigger means further including simultaneous locking and unlocking means for preventing accidental movement of the trigger means, the locking means including:

(i) a spindle mounted in the spray gun housing;

(ii) a trigger lock annularly mounted on the spindle;

(iii) a spring mounted on the spindle whereby said spring is torsionally resistant to rotational movement of the lock with respect to the spindle;

(iv) a recess formed in the lever so as to receive and engage the lock, said lock being capable of one-handed rotational movement with respect to the spindle, whereby pivotal movement of the lever towards the handle is only permitted when the lock is rotationally oriented so as to engage the recess;

(f) valve means mounted within the spray gun housing responsive to the position of the trigger means for controlling the outflow of the coating material from the accumulator;

(g) support means for rigidly connecting the spray gun handle and the accumulator; and (h) spray shield means mounted on the spray gun means for restricting back spray of the liquid coating.

2. The apparatus of claim 1, wherein the valve means comprises:

(a) an inlet housing mounted on the spray gun housing, said inlet housing including an internal passageway having a first end aligned with the second end of the conduit and a second end aligned with a nozzle, whereby the coating material traveling through the conduit, passageway, and nozzel escapes to the ambient environment in the form of a spray;

(b) a nozzle tip mounted with the inlet housing, including an annular valve seat concentrically inserted into the passageway;

(c) a rod-like shut off needle sealed and mounted within the passageway having a first end affixed to the trigger means responsive to the movement thereof, and a conically shaped second end for sealing engagement with the valve seat when the trigger means is in a closed position, whereby the outflow of coating materials is prevented.

3. The apparatus of claim 2, wherein the nozzles comprises:

(a) an orifice substantially smaller than the diameter of the passageway, the orifice restricting the flow of the liquid coating from the passageway to the ambient environment;

(b) a conically shaped spray funnel mounted concentrically with respect to the orifice, having a first end including an opening aligned with and adjacent to the orifice and a gradually expanding cross-section of the funnel body extending to a second end so as to guide the liquid coating emitting from the orifice as a spray.

4. The apparatus of claim 1, in which the spray shield means comprises:

(a) a cup shaped porous filter member mounted on the inlet housing of the valve means, opening away from the inlet housing, said cup shaped member trapping particles of the liquid coating deviating from a prescribed path, but allowing the venting of waste gases emitting therewith through the walls of the cup shaped member, whereby back spray of coating particles towards the spray gun is avoided and reactive forces are minimized.

5. The apparatus of claim 4, in which the cup shaped filter member further comprises:

(a) a first porous cup shaped inner layer having a generally coarse porosity;

(b) a second porous cup shaped outer layer mounted adjacent the first layer, having a substantially finer porosity than said first porous layer, whereby finer particles of the coating material not trapped by the first layer may be trapped by the second layer while allowing the venting of gases therewith.

6. The apparatus of claim 5, wherein the first and second porous cup shaped members are further comprised of an open celled flexible urethane foam, said urethane foam being mounted on a rigid bracket, said bracket having an angular flange for attachment to the inlet housing.

7. The accumulator of claim 1, further comprising:

(a) an insulating coating, said insulating coating forming an envelope covering substantially the entire outer surface of the accumulator means;

(b) a plurality of mixing balls, said mixing balls being contained within the bladder for agitation of the coating material while contained within the bladder;

(c) an outlet head, said head having a plurality of passageways, thereby assuring the uninterrupted outflow of coating material;

(d) an adaptor valve sealed and mounted in the outer shell so as to permit the introduction of pressurized propellant and preventing the escape thereof from the accumulator.

8. The apparatus of claim 1, wherein the support means comprises:

(a) a bracket having a first end affixed to the handle of the spray gun handle assembly and a second end in encircling engagement with the rigid outer shell of the accumulator, so as to increase the rigidity and strength of the spray gun;

(b) a tether ring mounted on the bracket for allowing the spray gun to be connected to a tether or line for securing the spray gun with respect to a space vehicle or the like.

* * * * *